US009909755B2

(12) United States Patent
Robertson et al.

(10) Patent No.: US 9,909,755 B2
(45) Date of Patent: Mar. 6, 2018

(54) LOW NOX COMBUSTION METHOD AND APPARATUS

(71) Applicant: Fives North American Combustion, Inc., Cleveland, OH (US)

(72) Inventors: Thomas F. Robertson, Medina Township, OH (US); Bruce E. Cain, Akron, OH (US); John J. Nowakowski, Richfield, OH (US); Mark C. Hannum, Hudson, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 692 days.

(21) Appl. No.: 13/833,359

(22) Filed: Mar. 15, 2013

(65) Prior Publication Data

US 2014/0272736 A1 Sep. 18, 2014

(51) Int. Cl.

| | |
|---|---|
| ***F23C 9/08*** | (2006.01) |
| ***F23R 3/34*** | (2006.01) |
| ***F23C 6/02*** | (2006.01) |
| ***F23D 23/00*** | (2006.01) |
| ***F23C 9/00*** | (2006.01) |
| ***F23C 5/08*** | (2006.01) |

(Continued)

(52) U.S. Cl.

CPC ..... *F23C 9/00* (2013.01); *F23C 5/08* (2013.01); *F23C 6/02* (2013.01); *F23C 6/047* (2013.01); *F23C 9/08* (2013.01); *F23D 23/00* (2013.01); *F23C 2201/101* (2013.01); *F23C 2202/50* (2013.01)

(58) Field of Classification Search

CPC ..... F23C 9/00; F23C 9/08; F23C 6/02; F23C 5/08; F23C 2202/50; F23C 2201/101; F23C 2201/30; F23C 9/06; F23C 6/047; F23C 2202/00; F23D 23/00; F23N 2021/12; F23R 3/04; F23R 3/02; F23R 3/34

USPC ..... 431/5, 12, 115, 116, 174, 177, 181; 60/605.2

See application file for complete search history.

(56) References Cited

U.S. PATENT DOCUMENTS

| | | | |
|---|---|---|---|
| 2,174,663 A | 10/1939 | Keller | |
| 2,188,133 A | 1/1940 | Hepburn | |

(Continued)

FOREIGN PATENT DOCUMENTS

| | | | |
|---|---|---|---|
| EP | 0573300 A2 * | 12/1993 | ..... F23C 6/047 |
| GB | 1043889 A * | 9/1966 | ..... F22B 1/22 |
| WO | WO 9609494 A1 * | 3/1996 | ..... F23C 3/00 |

*Primary Examiner* — Gregory Huson
*Assistant Examiner* — Daniel E Namay
(74) *Attorney, Agent, or Firm* — Benesch, Friedlander, Coplan & Aronoff LLP

(57) ABSTRACT

A low NOx combustion method includes steps of injecting reactants into a combustion chamber. A primary reactant stream, including fuel and combustion air premix, is injected from a premix burner port into the combustion chamber. A staged fuel stream is injected into the combustion chamber from a staged fuel injector port adjacent to the premix burner port. A stream of recirculated flue gas is injected into the combustion chamber from a flue gas injector port that is adjacent to the premix burner port and adjacent to the staged fuel injector port. In this manner, the stream of recirculated flue gas is injected into the combustion chamber unmixed with the primary reactant stream and unmixed with the staged fuel stream.

30 Claims, 4 Drawing Sheets

(51) Int. Cl.
*F23C 6/04* (2006.01)
*F23R 3/04* (2006.01)

(56) References Cited

U.S. PATENT DOCUMENTS 3,842,597 A * 10/1974 Ehrich ..... F02C 7/141 60/226.1
4,023,921 A * 5/1977 Anson ..... F23C 9/00 431/115
4,105,394 A * 8/1978 Reed ..... F23G 7/085 422/169
4,201,047 A * 5/1980 Warren ..... F23R 3/34 60/39.281
4,230,445 A * 10/1980 Janssen ..... F23C 7/004 431/116
4,395,223 A * 7/1983 Okigami ..... F23C 6/047 431/10
4,601,655 A 7/1986 Riley et al.
4,604,051 A 8/1986 Davies et al.
4,690,075 A * 9/1987 Vidal ..... F23C 5/08 110/264
4,708,638 A * 11/1987 Brazier ..... F23C 7/004 431/116
4,790,743 A * 12/1988 Leikert ..... F23C 6/047 110/186
4,800,866 A 1/1989 Finke
4,815,966 A * 3/1989 Janssen ..... F23C 7/00 431/115
4,945,841 A 8/1990 Nakamachi et al.
5,154,599 A * 10/1992 Wunning ..... F23B 90/06 110/204
5,201,650 A 4/1993 Johnson
5,249,952 A * 10/1993 West ..... F23G 5/14 110/235
5,275,554 A 1/1994 Faulkner
5,403,181 A 4/1995 Tanaka et al.
5,411,394 A * 5/1995 Beer ..... F23C 7/006 110/262
5,458,481 A * 10/1995 Surbey ..... F23C 9/006 431/115
5,460,512 A * 10/1995 Lifshits ..... F23C 6/047 431/115
5,562,438 A 10/1996 Gordon et al.
5,573,391 A 11/1996 Benson et al.
5,605,452 A 2/1997 Robertson et al.
5,628,184 A * 5/1997 Santos ..... F02C 3/22 60/39.281
5,636,977 A * 6/1997 Benson ..... F23C 6/047 431/115
5,749,217 A * 5/1998 Etheridge ..... F02C 9/18 60/39.23
5,769,624 A 6/1998 Luxton et al.
5,823,769 A * 10/1998 Joshi ..... C03B 5/235 432/179
5,896,741 A * 4/1999 Etheridge ..... F02C 9/18 60/39.23
5,974,780 A * 11/1999 Santos ..... F02C 3/22 60/39.59
6,027,330 A * 2/2000 Lifshits ..... F23C 7/004 110/204
6,029,614 A * 2/2000 Kayahara ..... F22B 21/065 122/367.1
6,036,476 A * 3/2000 Mitani ..... F23C 3/002 126/91 A
6,039,560 A 3/2000 Kubota
6,089,170 A 7/2000 Conti et al.
6,206,686 B1 3/2001 Nieszczur et al.
6,383,461 B1 * 5/2002 Lang ..... F23C 9/08 110/345
6,471,508 B1 * 10/2002 Finke ..... F23C 9/006 431/11
6,536,204 B2 * 3/2003 Lenz ..... F23C 3/00 60/39.37
6,672,859 B1 * 1/2004 Rabovitser ..... F23C 6/047 431/10
6,793,486 B2 * 9/2004 Finke ..... F23C 9/006 431/10
6,796,789 B1 * 9/2004 Gibson ..... F23C 3/00 431/11
6,865,994 B2 * 3/2005 Seeker ..... F23L 9/04 110/203
6,938,560 B2 * 9/2005 Okazaki ..... F23C 6/045 110/204
7,264,466 B2 9/2007 Miller et al.
7,374,735 B2 * 5/2008 Swanson ..... B01D 53/56 423/235
7,594,811 B2 * 9/2009 Lugnet ..... F23C 6/045 431/10
7,670,135 B1 * 3/2010 Zink ..... F23C 9/00 431/116
8,002,541 B2 8/2011 Neville et al.
2001/0025491 A1 * 10/2001 Lenz ..... F23C 3/00 60/725
2001/0034001 A1 10/2001 Poe et al.
2002/0197574 A1 * 12/2002 Jones ..... F23C 6/047 431/8
2003/0008255 A1 * 1/2003 Finke ..... F23C 9/006 431/215
2005/0053877 A1 * 3/2005 Feese ..... F23C 6/045 431/10
2005/0074711 A1 * 4/2005 Cain ..... F23C 5/08 431/9
2006/0057516 A1 * 3/2006 Miller ..... F23C 3/002 431/8
2006/0115780 A1 * 6/2006 Kiyama ..... F23C 9/08 431/182
2006/0240370 A1 * 10/2006 Neville ..... F23C 6/047 431/12
2007/0141519 A1 * 6/2007 Lauer ..... F23R 3/34 431/11
2007/0154855 A1 * 7/2007 Gibson ..... F23C 9/006 431/9
2007/0269755 A2 * 11/2007 Gibson ..... F23C 9/006 431/9
2008/0098967 A1 * 5/2008 Garg ..... F22B 21/343 122/155.1
2008/0141921 A1 * 6/2008 Hinderks ..... B63B 1/28 114/274
2009/0249988 A1 * 10/2009 Davidian ..... F23C 9/00 110/345
2010/0077946 A1 * 4/2010 D'Agostini ..... F01K 3/20 110/345
2010/0162710 A1 * 7/2010 Senior ..... F23R 3/34 60/737
2010/0239989 A1 * 9/2010 Ekman ..... F23C 9/006 431/10
2010/0248175 A1 9/2010 Cain et al.
2011/0067405 A1 * 3/2011 Armstrong ..... B01D 53/228 60/752
2011/0277467 A1 * 11/2011 Dravis ..... F02C 1/02 60/605.1
2012/0198836 A1 * 8/2012 Marcil ..... F01M 13/021 60/600
2012/0304650 A1 * 12/2012 Hernandez ..... F23R 3/14 60/737
2013/0047900 A1 * 2/2013 Bool ..... F23C 9/00 110/205
2013/0125798 A1 * 5/2013 Taylor ..... F23C 9/00 110/205
2013/0203003 A1 * 8/2013 Cain ..... F23D 14/02 432/11
2014/0123624 A1 * 5/2014 Minto ..... F23N 5/18 60/39.281
2014/0318513 A1 * 10/2014 Kovac ..... F02B 29/0475 123/568.12

* cited by examiner

LOW NOX COMBUSTION METHOD AND APPARATUS

TECHNICAL FIELD

This technology relates to a heating system in which combustion produces oxides of nitrogen (NOx), and specifically relates to a method and apparatus for suppressing the production of NOx.

BACKGROUND

Certain industrial processes, such as heating a load in a furnace or generating steam in a boiler, rely on heat produced by the combustion of fuel and oxidant in a combustion chamber. The fuel is typically natural gas. The oxidant is typically air, vitiated air or air enriched with oxygen. Combustion of the fuel and oxidant in the combustion chamber causes NOx to result from the combination of oxygen and nitrogen. It may be desirable to suppress the production of NOx.

SUMMARY OF THE INVENTION

A method of low NOx combustion includes steps of injecting reactants into a combustion chamber. A primary reactant stream, including fuel and combustion air premix, is injected from a premix burner port into the combustion chamber. A staged fuel stream is injected into the combustion chamber from a staged fuel injector port adjacent to the premix burner port. A stream of recirculated flue gas is injected into the combustion chamber from a flue gas injector port adjacent to the premix burner port and the staged fuel injector port. In this manner, the stream of recirculated flue gas is injected into the combustion chamber unmixed with the primary reactant stream and unmixed with the staged fuel stream.

Preferably, at least a portion of the stream of recirculated flue gas is injected into the combustion chamber between the primary reactant stream and the staged fuel stream, whereby the stream of recirculated flue gas shields the staged fuel stream from combustion temperatures at the primary reactant stream.

Summarized differently, a method of low NOx combustion includes injecting primary fuel, staged fuel, and combustion air into a combustion chamber in streams. The streams include a primary reactant stream containing primary fuel and combustion air premix, and a staged reactant stream containing staged fuel. Combustion air is injected into the combustion chamber in a total amount and at a total flow rate. Recirculated flue gas also is injected into the combustion chamber in a total amount. The total amount of recirculated flue gas is injected separately from the primary fuel, and is injected at a total flow rate greater than the total flow rate of combustion air.

DETAILED DESCRIPTION

Figure 1:
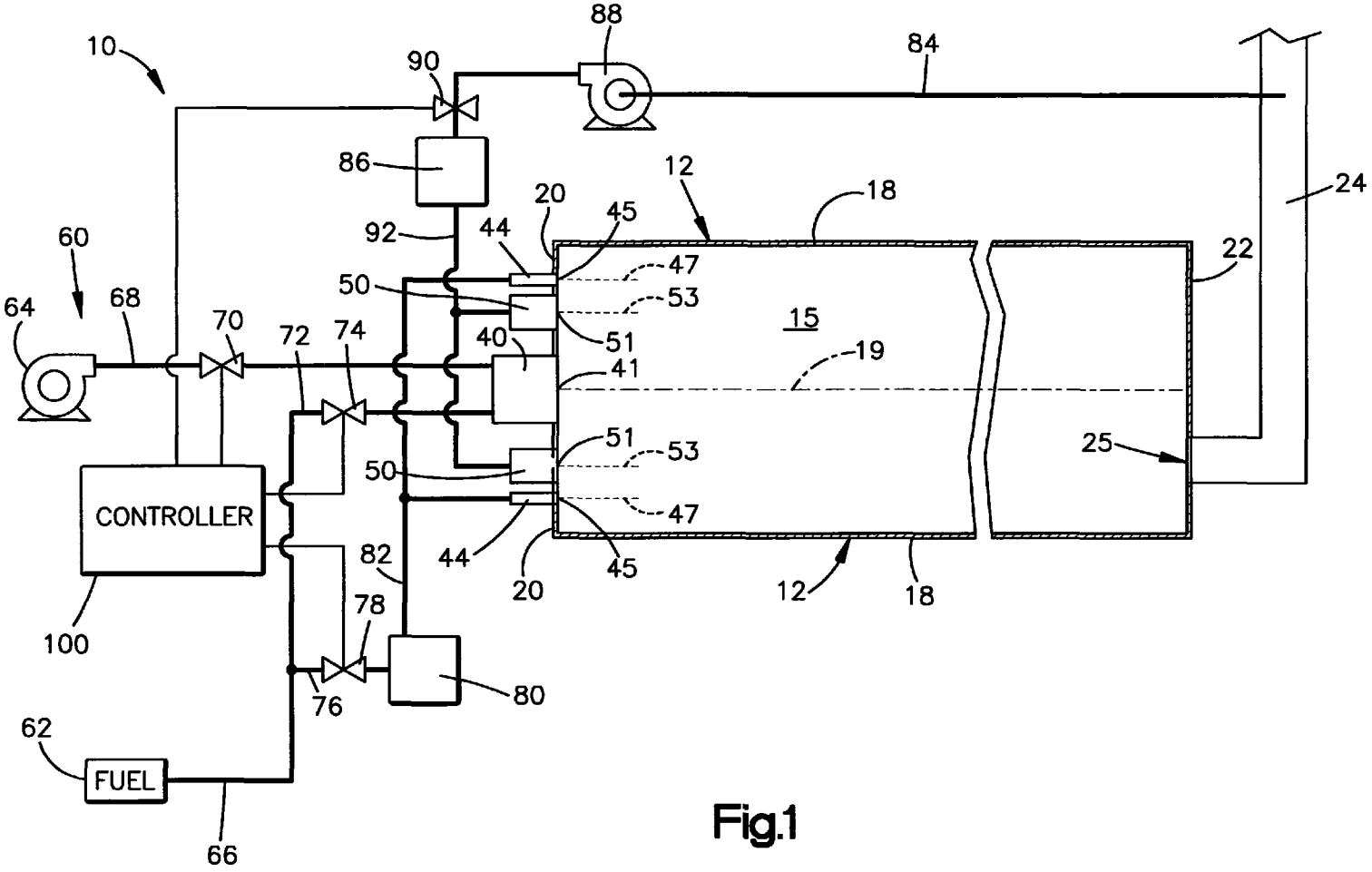
FIG. 1 is a schematic view of a heating system including a combustion chamber.

The apparatus shown schematically in the drawings can be operated in steps that are examples of the elements recited in the method claims, and has parts that are examples of the elements recited in the apparatus claims. The illustrated apparatus thus include examples of how a person of ordinary skill in the art can make and use the claimed invention. It is described here to meet the enablement and best mode requirements of the patent statute without imposing limitations that are not recited in the claims. The various parts of the illustrated apparatus, as shown, described and claimed, may be of either original and/or retrofitted construction as required to accomplish any particular implementation of the invention, and all or part of each embodiment can be used in combination with all or part of any one or more of the others.

The apparatus 10 that is shown for example in FIG. 1 is a heating system for a low temperature boiler known as a steam generator. The parts of the heating system 10 that are shown schematically in FIG. 1 include a radiant heating structure 12. The radiant heating structure 12 encloses an elongated cylindrical combustion chamber 15, and has an elongated cylindrical side wall 18, a longitudinal central axis 19, and a pair of axially opposite end walls 20 and 22. Reactants are delivered to the combustion chamber 15 such that products of combustion generated within the chamber 15 will flow axially from the first end wall 20 to the second end wall 22, and outward to a flue 24 through an exhaust port 25 in the second end wall 22. This enables heat to be radiated outward along the length of the side wall 18.

The reactants delivered to the combustion chamber 15 include fuel and combustion air. The combustion air is preferably delivered in a single stage. The fuel is delivered in primary and secondary stages simultaneously with delivery of the combustion air. Recirculated flue gas is delivered to the combustion chamber 15 to vitiate other reactants and thereby to suppress the production of NOx.

A premix burner 40 delivers the combustion air and primary fuel to the combustion chamber 15. As shown in FIG. 1, the premix burner 40 is located at the first end wall 20 of the radiant heating structure 12, and has a port 41 facing into the chamber 15. The port 41 in this example is centered on the longitudinal central axis 19 of the chamber 15.

A plurality of secondary fuel injectors 44 deliver the secondary fuel. The secondary fuel injectors 44, two of which are shown in FIG. 1, are located adjacent to the premix burner 40. Since an alternative embodiment of the invention may have multiple premix burners instead of the single premix burner 40 in the embodiment of FIG. 1, "adjacent" to a burner means closer to that burner than to any other burner or burners, if any, that inject a primary reactant stream into the same combustion chamber.

As shown, the secondary fuel injectors 44 are preferably located at the first end wall 20, and are preferably arranged in a circular array centered on the longitudinal axis 19. Each secondary fuel injector 44 has a port 45 facing into the chamber 15 along a respective axis 47. The axes 47 of the fuel injector ports 45 are preferably parallel to the axis 19, but one or more could be inclined to the axis 19 to inject secondary fuel in a skewed direction.

Flue gas recirculation (FGR) injectors 50 are located adjacent to the premix burner 40 and the secondary fuel injectors 44. In this example, the FGR injectors 50 are arranged in a circular array concentric with, and radially inward of, the array of secondary fuel injectors 44. Each FGR injector 50 has a port 51 facing into the chamber 15 along a respective axis 53 that is preferably parallel to the adjacent fuel injector axis 47.

As further shown in FIG. 1, a reactant supply and control system 60 includes lines and valves that convey the reactants to the premix burner 40, the secondary fuel injectors 44, and the FGR injectors 50. A fuel source 62, which in this example is a supply of natural gas, and a combustion air source 64, which in this example is an air blower, provide streams of those reactants along respective supply lines 66 and 68.

The combustion air supply line 68 extends directly to the premix burner 40, and has a combustion air control valve 70. A first branch line 72 extends from the fuel supply line 66 to the premix burner 40, and has a primary fuel control valve 74. A second branch line 76 has a secondary fuel control valve 78, and extends from the fuel supply line 66 to a fuel distribution manifold 80. The manifold 80 communicates with the secondary fuel injectors 44 through fuel distribution lines 82.

The reactant supply and control system 60 further includes an FGR line 84 reaching from the flue 24 to an FGR manifold 86. The FGR line has a blower 88 and a control valve 90. FGR distribution lines 92 communicate the FGR manifold 86 with the FGR injectors 50.

Figure 2:
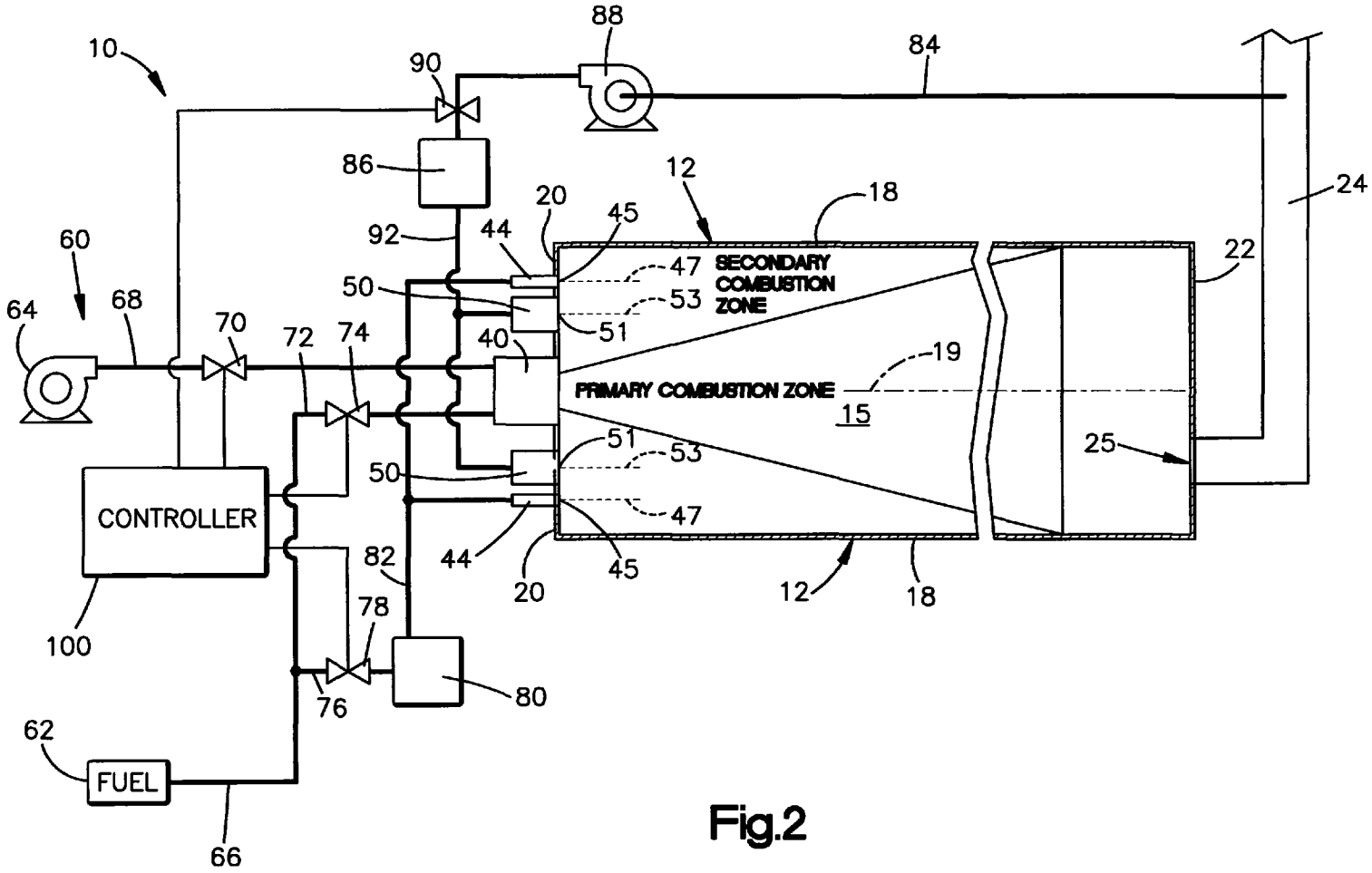
FIG. 2 is a view similar to FIG. 1, schematically illustrating operating conditions within the combustion chamber of FIG. 1.

A controller 100 in the reactant supply and control system 60 is operatively associated with the blower 64 and the valves 70, 74, 78 and 90 to initiate, regulate and terminate flows through the valves 70, 74, 78 and 90. Specifically, the controller 100 has combustion controls in the form of hardware and/or software for actuating the blower 64 and the valves 70, 74, 78 and 90 in a manner that causes combustion of the reactants to proceed axially downstream through the chamber 15 in generally distinct stages that occur in the generally distinct zones identified in FIG. 2. The controller 100 shown schematically in the drawings may thus comprise any suitable programmable logic controller of other control device, or combination of control devices, that is programmed or otherwise configured to perform as described and claimed.

In operation, the controller 100 actuates the combustion air control valve 70 and the primary fuel control valve 74 to provide the premix burner 40 with a stream of combustion air and a stream of primary fuel. Those reactant streams mix together inside the premix burner 40 to form premix. The premix is delivered to the combustion chamber 15 as a primary reactant stream directed from the port 41 along the longitudinal central axis 19. Ignition of the premix occurs within the premix burner 40. This causes the primary reactant stream to form a primary combustion zone that expands radially outward from the port 41 as combustion proceeds downstream along the axis 19.

The controller 100 actuates the secondary fuel control valve 78 to provide the secondary fuel injectors 44 with streams of secondary fuel. The secondary fuel streams are injected from the secondary ports 45 which, as described above, are located radially outward of the primary port 41. This causes the unignited streams of secondary fuel to form a combustible mixture with reactants and products of combustion that recirculate in the upstream corner portions of the combustion chamber 15. Auto-ignition of that combustible mixture creates a secondary combustion zone that surrounds the primary combustion zone at the upstream end portion of the chamber 15.

The controller 100 also actuates the FGR control valve 90 to provide the FGR injectors 50 with streams of recirculated flue gas. The streams of recirculated flue gas are then injected from the FGR ports 51 into the secondary combustion zone to mix with the gaseous contents of the secondary zone. This helps to suppress the production of NOx by vitiating the products of combustion in the secondary zone.

Figure 3:
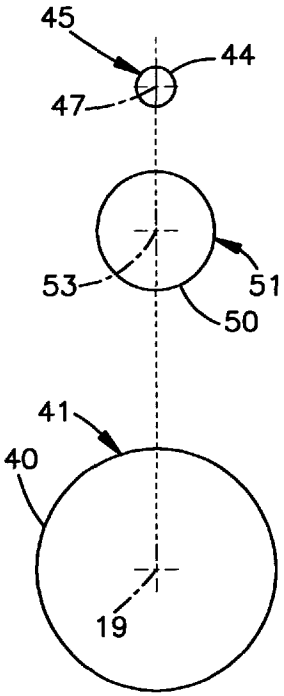
FIG. 3 is an enlarged partial view of parts of the heating system of FIG. 1.

Each stream of recirculated flue gas is injected from an FGR port 51 in a condition not yet mixed with the stream of secondary fuel injected from the adjacent secondary fuel port 45. Additionally, as noted above and shown partially in FIG. 3, the FGR ports 51 are preferably located between the premix burner port 41 and the secondary fuel injector ports 45. Each stream of recirculated flue gas is thus injected into the combustion chamber 15 between the primary reactant stream and the adjacent staged fuel stream. These injection arrangements help the streams of recirculated flue gas to shield the staged fuel streams from combustion temperatures in the primary combustion zone, which are normally higher than combustion temperatures in the secondary zone. By maintaining relatively lower combustion temperatures in this manner, the production of NOx is suppressed accordingly.

Figure 4:
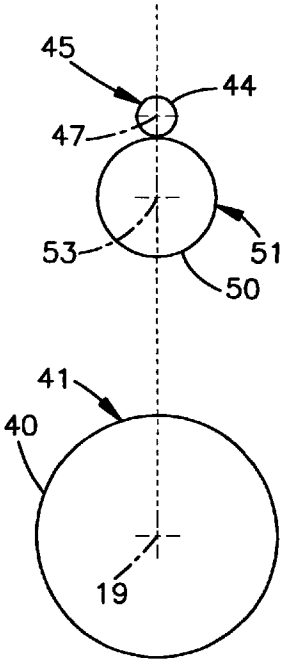
FIGS. 4-6 are views similar to FIG. 3, showing alternative arrangements for parts of the heating system of FIG. 1.
Figure 5:
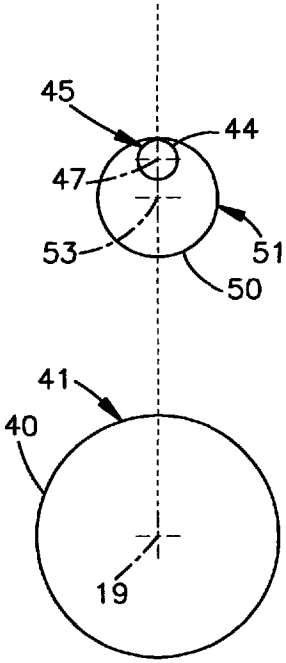
Figure 6:
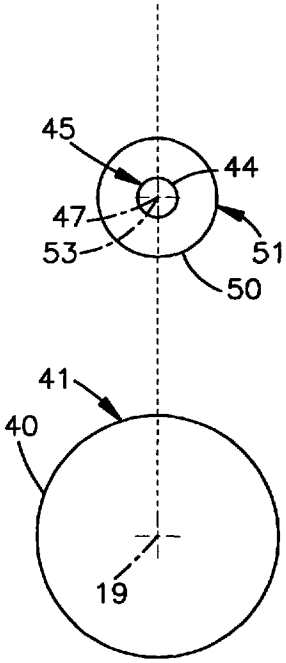

Other examples of FGR port arrangements are shown in FIGS. 4-6. The arrangement of FIG. 4 is similar to the arrangement of FIG. 3, but the FGR port 51 is closer to the adjacent secondary fuel injector port 45 to provide greater shielding. In the arrangements of FIGS. 5 and 6, the secondary fuel port 45 is located within the adjacent FGR port 51 for more extensive shielding, with the secondary port 45 of FIG. 6 centered within the adjacent FGR port 51 such that the FGR stream will have an annular configuration surrounding the secondary fuel stream. In each of these examples, at least a portion of the stream of recirculated flue gas is injected into the combustion chamber between the primary reactant stream and the adjacent staged fuel stream for shielding the staged fuel stream from combustion temperatures at the primary reactant stream. Additionally, the flow area of the FGR port 51 is greater than the flow area of the adjacent secondary fuel injector port 45. The greater flow areas are helpful for injecting the streams of recirculated flue gas at pressures and velocities significantly less than the pressures and velocities of the adjacent streams of secondary fuel.

In addition to providing the generally distinct combustion zones within the combustion chamber 15, and providing the NOx-suppressing FGR streams, the controller 100 can further suppress the production of NOx by maintaining fuel-lean combustion throughout the two zones. For example, the controller 100 can actuate the valves 70, 74, and 78 to deliver fuel and combustion air to the combustion chamber 15 at target rates of delivery that together have a target fuel to oxidant ratio, with the target rate of oxidant being provided entirely by the combustion air in the primary reactant stream, and with the target rate of fuel being provided at first and second partial rates in the primary reactant stream and the secondary fuel streams, respectively. The first partial target rate of fuel is higher than the second partial target rate, but is preferably low enough to ensure that the premix, and consequently the primary reactant stream, is fuel-lean. This helps to ensure that combustion in the primary zone is fuel-lean.

The second partial target rate also is preferably low enough to ensure that the resulting combustion is fuel-lean rather than fuel-rich. This helps to avoid the production of NOx that would occur if the secondary fuel were to form a fuel-rich mixture with the relatively low concentration of oxidant in the gasses that recirculate in the secondary zone. Fuel-lean conditions in the secondary zone also help to avoid the high temperature production of NOx that can occur at the interface between the primary and secondary zones when fuel from the secondary zone forms a combustible mixture with oxidant from the primary zone. However, the NOx-suppressing effects of the recirculated flue gas, as described above, may permit the second partial target rate of fuel injection to have a fuel to oxidant ratio that is higher than it might be otherwise.

Figure 7:
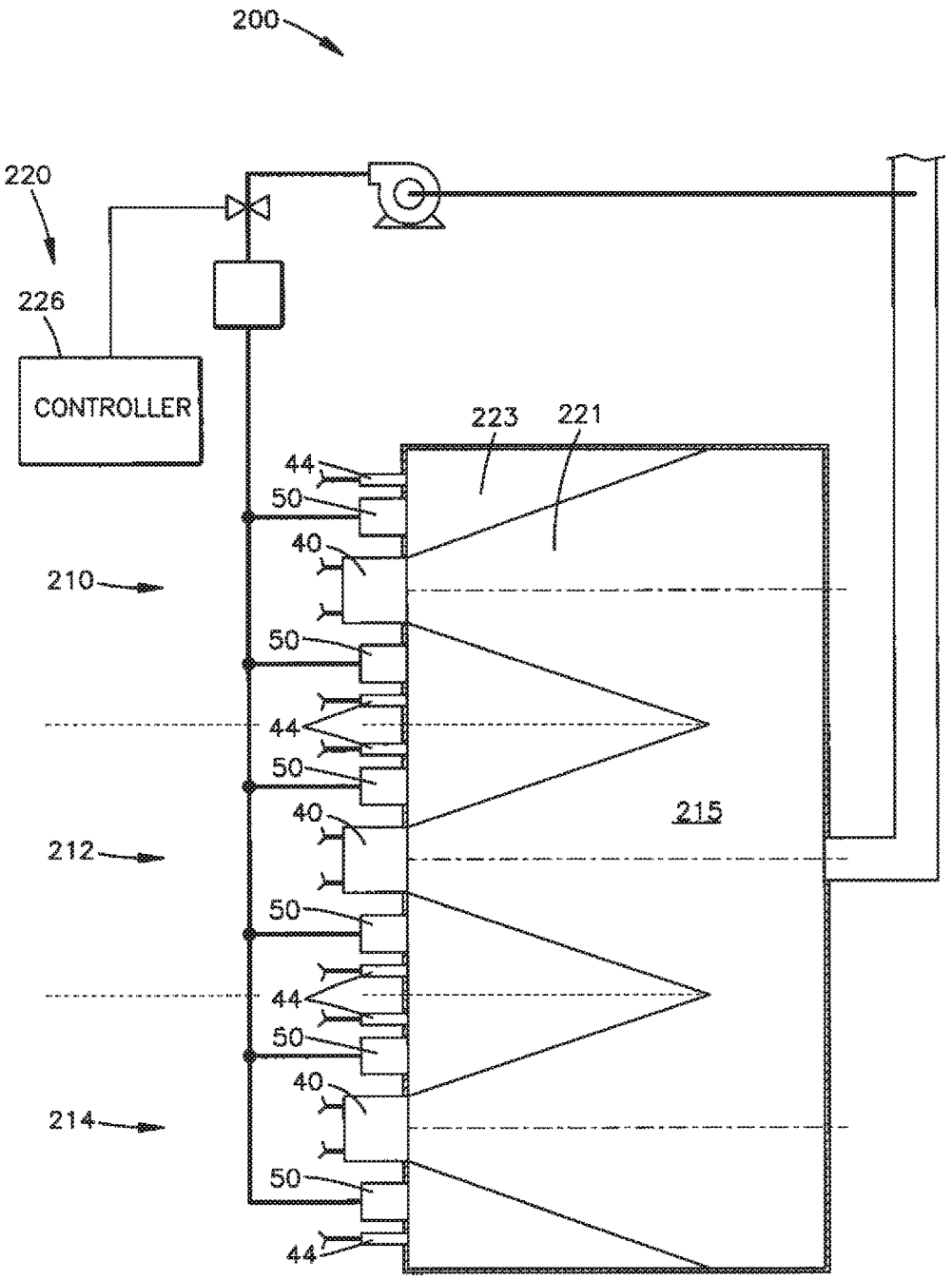
FIG. 7 is a schematic view of an alternative heating system including a combustion chamber.

Parts of an alternative heating system 200 are shown schematically in FIG. 7. This heating system 200 includes multiple separate arrays 210, 212 and 214 of reactant delivery structures. Like the single array of reactant delivery structures in the heating apparatus 10 described above, each of the multiple separate arrays 210, 212 and 214 of reactant delivery structures includes a single respective premix burner 40, secondary fuel injectors 44 adjacent to the respective premix burner 40, and FGR injectors 50 adjacent to the respective premix burner 40 and the respective secondary fuel injectors 44. Each port in an array 210, 212 or 214 is thus considered to be adjacent to the other ports in the same array 210, 212 or 214, and remote from the ports in either of the other arrays 210, 212 or 214.

Each of the multiple separate arrays 210, 212 and 214 of reactant delivery structures is oriented transversely across an elongated combustion chamber 215, and is operatively interconnected with a reactant supply and control system 220 (shown partially) in the same manner as the single array described above. Accordingly, each array 210, 212 and 214 is operative with reference to corresponding primary and secondary combustion zones 221 and 223 that extend across the combustion chamber 215, as shown schematically in FIG. 7.

The controller 226 for the heating system 200 is preferably configured for each array 210, 212 and 214 to deliver respective target rates of fuel and oxidant that together define a respective fractional portion of an overall combined target rate of fuel and oxidant delivered to the combustion chamber 215. The controller 226 also provides streams of recirculated flue gas at each array 210, 212 and 214 of reactant delivery structures in the manner described above. The overall combined target rate of reactant delivery is provided by simultaneous operation of all of the multiple arrays 210, 212 and 214.

Further regarding the single array of reactant delivery structures in the heating apparatus 10, combustion air is injected into the combustion chamber 15 in a total amount. The total amount of combustion air is injected at a total flow rate. The recirculated flue gas also is injected into the combustion chamber 15 in a total amount. However, the total amount of recirculated flue gas is preferably injected into the combustion chamber 15 at a total flow rate that is greater than the total flow rate of combustion air injection. The total flow rate of recirculated flue gas injection can exceed the total flow rate of combustion air injection because, unlike the combustion air, the recirculated flue gas is not injected within a primary reactant stream, and therefore can have a flow rate that would blow off the flame at a burner if provided in a primary reactant stream. Recirculated flue gas can thus be injected into the combustion chamber 15 as desired to suppress NOx without affecting flame stability. Similarly, in the embodiment of FIG. 7, combustion air is injected from the multiple arrays of reactant delivery structures 210, 212 and 214 into the combustion chamber 215 in a total amount and at a total flow rate. Recirculated flue gas is injected from the multiple arrays of reactant delivery structures 210, 212 and 214 into the combustion chamber 215 in a total amount, with the total amount of recirculated flue gas being injected at a total flow rate that is greater than the total flow rate of combustion air.

This written description sets forth the best mode of carrying out the invention, and describes the invention so as to enable a person skilled in the art to make and use the invention, by presenting examples of elements recited in the claims. The patentable scope of the invention is defined by the claims, and may include other examples that occur to those skilled in the art. Such other examples, which may be available either before or after the application filing date, are intended to be within the scope of the claims if they have structural or method elements that do not differ from the literal language of the claims, or if they have equivalent structural or method elements with insubstantial differences from the literal language of the claims.

The invention claimed is:

1. A method comprising:

injecting a primary reactant stream, including primary fuel gas and combustion air premix, into a combustion chamber;

injecting staged reactant streams that consist of secondary fuel gas into the combustion chamber adjacent to the primary reactant stream; and injecting streams of recirculated flue gas into the combustion chamber adjacent to the primary reactant stream and adjacent to the staged reactant streams, whereby the streams of recirculated flue gas are injected into the combustion chamber unmixed with the primary reactant stream and unmixed with the staged reactant streams.

2. A method as defined in claim 1 wherein the streams of recirculated flue gas are injected into the combustion chamber between the primary reactant stream and the staged reactant streams, whereby the streams of recirculated flue gas shield the staged reactant streams from combustion temperatures at the primary reactant stream.

3. A method as defined in claim 1 wherein the staged reactant streams are injected into the combustion chamber with a first flow area, and the streams of recirculated flue gas are injected into the combustion chamber with a second flow area greater than the first flow area.

4. A method as defined in claim 1 wherein the staged reactant streams are injected into the combustion chamber within the streams of recirculated flue gas.

5. A method as defined in claim 1 wherein the streams of recirculated flue gas are injected into the combustion chamber in an annular configuration surrounding the staged reactant streams.

6. A method as defined in claim 1 wherein the staged reactant streams are injected into the combustion chamber at a first pressure, and the streams of recirculated flue gas are injected into the combustion chamber at a second pressure less than the first pressure.

7. A method as defined in claim 1 wherein the staged reactant streams are injected into the combustion chamber at a first velocity, and the streams of recirculated flue gas are injected into the combustion chamber at a second velocity less than the first velocity.

8. A method as defined in claim 1 wherein combustion air is injected into the combustion chamber at a total flow rate, and recirculated flue gas is injected into the combustion chamber at a total flow rate greater than the total flow rate of combustion air.

9. A method as defined in claim 1 wherein the fuel and combustion air are injected at total target rates that together provide a target fuel-to-oxidant ratio, the total target rate of fuel is provided by partial target rates in the primary reactant stream and the staged reactant streams, and the total target rate of combustion air is provided entirely in the primary reactant stream.

10. A method comprising:

injecting a primary reactant stream, including primary fuel gas and combustion air premix, into a combustion chamber;

injecting a staged reactant stream that consists of secondary fuel gas into the combustion chamber adjacent to the primary reactant stream at a first pressure; and injecting a stream consisting of recirculated flue gas into the combustion chamber between the primary reactant stream and the staged reactant stream at a second pressure less than the first pressure.

11. A method as defined in claim 10 wherein the staged reactant stream is injected into the combustion chamber with a first flow area, and the stream consisting of recirculated flue gas is injected into the combustion chamber with a second flow area greater than the first flow area.

12. A method as defined in claim 10 wherein the staged reactant stream is injected into the combustion chamber within the stream consisting of recirculated flue gas.

13. A method as defined in claim 10 wherein the stream consisting of recirculated flue gas is injected into the combustion chamber in an annular configuration surrounding the staged reactant stream.

14. A method as defined in claim 10 wherein the staged reactant stream is injected into the combustion chamber at a first velocity, and the stream consisting of recirculated flue gas is injected into the combustion chamber at a second velocity less than the first velocity.

15. A method as defined in claim 10 wherein combustion air is injected into the combustion chamber at a total flow rate, and recirculated flue gas is injected into the combustion chamber at a total flow rate greater than the total flow rate of combustion air.

16. A method comprising:

injecting a primary reactant stream, including primary fuel gas and combustion air premix, into a combustion chamber;

injecting a staged reactant stream consisting of secondary fuel gas into the combustion chamber adjacent to the primary reactant stream at a first velocity; and injecting a stream consisting of recirculated flue gas into the combustion chamber between the primary reactant stream and the staged reactant stream at a second velocity less than the first velocity.

17. A method as defined in claim 16 wherein the staged reactant stream is injected into the combustion chamber with a first flow area, and the stream consisting of recirculated flue gas is injected into the combustion chamber with a second flow area greater than the first flow area.

18. A method as defined in claim 16 wherein the staged reactant stream is injected into the combustion chamber within the stream consisting of recirculated flue gas.

19. A method as defined in claim 16 wherein the stream consisting of recirculated flue gas is injected into the combustion chamber in an annular configuration surrounding the staged reactant stream.

20. A method as defined in claim 16 wherein combustion air is injected into the combustion chamber at a total flow rate, and recirculated flue gas is injected into the combustion chamber at a total flow rate greater than the total flow rate of combustion air.

21. A method comprising:

injecting primary fuel, staged fuel, and combustion air into a combustion chamber in streams comprising a primary reactant stream containing primary fuel gas and combustion air premix, and staged reactant streams consisting of secondary fuel gas, with combustion air being injected into the combustion chamber at a total flow rate provided entirely in the primary reactant stream; and injecting recirculated flue gas into the combustion chamber separately from the primary and staged reactant streams and at a total flow rate greater than the total flow rate of combustion air.

22. An apparatus comprising:

a structure defining a combustion chamber having an end wall;

a premix burner having a port facing into the combustion chamber;

staged fuel injector ports located at the end wall and facing into the combustion chamber adjacent to the premix burner port;

flue gas injector ports facing into the combustion chamber adjacent to the premix burner port and adjacent to the staged fuel injector ports;

means for providing the premix burner port with reactants including combustion air and primary fuel gas;

means for providing the staged fuel injector ports with reactants consisting of secondary fuel gas; and means for providing the flue gas injector ports with reactants consisting of recirculated flue gas.

23. An apparatus as defined in claim 22 wherein the flue gas injector ports are located between the premix burner port and the staged fuel injector ports.

24. An apparatus as defined in claim 22 wherein the staged fuel injector ports have first flow areas, and the flue gas injector ports have second flow areas greater than the first flow areas.

25. An apparatus as defined in claim 22 wherein the staged fuel injector ports are located within the flue gas injector ports.

26. An apparatus as defined in claim 22 wherein the flue gas injector ports have annular configurations surrounding the staged fuel injector ports.

27. An apparatus as defined in claim 22 further comprising means for injecting fuel and combustion air at total target rates that together provide a target fuel-to-oxidant ratio, with the total target rate of fuel provided by partial target rates in the primary reactant stream and the staged fuel streams, and with the total target rate of combustion air provided entirely in the primary reactant stream.

28. An apparatus comprising:

a structure defining a combustion chamber having an end wall;

means for injecting a primary reactant stream, including fuel and combustion air premix, into the combustion chamber;

means for injecting a staged reactant stream consisting of secondary fuel gas from the end wall into the combustion chamber adjacent to the primary reactant stream at a first pressure; and means for injecting a stream consisting of recirculated flue gas into the combustion chamber between the primary reactant stream and the staged reactant stream at a second pressure less than the first pressure.

29. An apparatus comprising:

a structure defining a combustion chamber having an end wall;

means for injecting a primary reactant stream, including fuel and combustion air premix, into the combustion chamber;

means for injecting a staged reactant stream consisting of secondary fuel gas from the end wall into the combustion chamber adjacent to the primary reactant stream at a first velocity; and means for injecting a stream consisting of recirculated flue gas into the combustion chamber between the primary reactant stream and the staged reactant stream at a second velocity less than the first velocity.

30. An apparatus comprising:

a structure defining a combustion chamber having an end wall;

means for injecting primary fuel, staged fuel, and combustion air into the combustion chamber in streams comprising a primary reactant stream containing primary fuel and combustion air premix, and staged reactant streams consisting of secondary fuel gas injected from the end wall into the combustion chamber, with combustion air being injected into the combustion chamber in a total amount and at a total flow rate provided entirely in the primary reactant stream; and means for injecting recirculated flue gas into the combustion chamber in a total amount, with the total amount of recirculated flue gas being injected separately from the primary and staged reactant streams and at a total flow rate greater than the total flow rate of combustion air.

* * * * *